US008283864B2

(12) United States Patent
Kawarazaki et al.

(10) Patent No.: US 8,283,864 B2
(45) Date of Patent: Oct. 9, 2012

(54) PLASMA DISPLAY PANEL WITH PROTECTIVE LAYER COMPRISING CRYSTAL PARTICLES OF MAGNESIUM OXIDE

(75) Inventors: Hideji Kawarazaki, Osaka (JP); Keiji Horikawa, Osaka (JP); Chiharu Koshio, Kyoto (JP); Kanako Okumura, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/201,708

(22) PCT Filed: Feb. 8, 2011

(86) PCT No.: PCT/JP2011/000677
§ 371 (c)(1),
(2), (4) Date: Aug. 16, 2011

(87) PCT Pub. No.: WO2011/099265
PCT Pub. Date: Aug. 18, 2011

(65) Prior Publication Data

US 2011/0298364 A1 Dec. 8, 2011

(30) Foreign Application Priority Data

Feb. 12, 2010 (JP) ..... 2010-028461
Feb. 12, 2010 (JP) ..... 2010-028462

(51) Int. Cl.
*H01J 17/49* (2012.01)

(52) U.S. Cl. ..... 313/587; 313/582; 313/586

(58) Field of Classification Search ..... 313/582–587
See application file for complete search history.

(56) References Cited

U.S. PATENT DOCUMENTS 7,759,868 B2 * 7/2010 Naoi et al. ..... 313/586
7,977,883 B2 * 7/2011 Kim et al. ..... 313/587
8,018,154 B2 * 9/2011 Fukui et al. ..... 313/582
8,035,288 B2 * 10/2011 Chu et al. ..... 313/489

(Continued)

FOREIGN PATENT DOCUMENTS

JP 8-236028 9/1996

(Continued)

OTHER PUBLICATIONS

International Search Report issued Apr. 19, 2011 in International (PCT) Application No. PCT/JP2011/000677.

(Continued)

*Primary Examiner* — Sikha Roy
(74) *Attorney, Agent, or Firm* — Wenderoth, Lind & Ponack, L.L.P.

(57) ABSTRACT

A plasma display panel has a front plate, and a rear plate arranged so as to be opposed to the front plate. The front plate has a display electrode, a dielectric layer to cover the display electrode, and a protective layer to cover the dielectric layer. The protective layer has a luminescence peak in a wavelength ranging from not less than 350 nm to not more than 550 nm under irradiation of light having a wavelength of 146 nm. In addition, the protective layer has a luminescence peak in a wavelength ranging from not less than 350 nm to not more than 550 nm under irradiation of light having a wavelength of 173 nm. A ratio A/B between a peak intensity of luminescence under the light having the wavelength of 146 nm and a peak intensity of luminescence under the light having the wavelength of 173 nm falls within a range from more than 3.0 to not more than 7.0.

3 Claims, 9 Drawing Sheets

U.S. PATENT DOCUMENTS

| | | | |
|---|---|---|---|
| 2008/0309238 | A1 | 12/2008 | Choi et al. |
| 2009/0021164 | A1 | 1/2009 | Maeshima et al. |
| 2009/0153018 | A1 | 6/2009 | Naoi et al. |

FOREIGN PATENT DOCUMENTS

| | | |
|---|---|---|
| JP | 10-334809 | 12/1998 |
| JP | 11-339665 | 12/1999 |
| JP | 2002-260535 | 9/2002 |
| JP | 2005-353455 | 12/2005 |
| JP | 2006-59779 | 3/2006 |
| JP | 2008-171751 | 7/2008 |
| JP | 2008-311203 | 12/2008 |
| JP | 2009-164098 | 7/2009 |

OTHER PUBLICATIONS

Written Opinion of the International Searching Authority issued Apr. 19, 2011 in International (PCT) Application No. PCT/JP2011/000677.

* cited by examiner

PLASMA DISPLAY PANEL WITH PROTECTIVE LAYER COMPRISING CRYSTAL PARTICLES OF MAGNESIUM OXIDE

THIS APPLICATION IS A U.S. NATIONAL PHASE APPLICATION OF PCT INTERNATIONAL APPLICATION PCT/JP2011/000677.

TECHNICAL FIELD

A technique disclosed here relates to a plasma display panel used in a display device.

BACKGROUND ART

A plasma display panel (hereinafter, referred to as the PDP) has a front plate and a rear plate. The front plate has a glass substrate, a display electrode formed on one main surface of the glass substrate, a dielectric layer to cover the display electrode and serve as a capacitor, and a protective layer formed of a magnesium oxide (MgO) on the dielectric layer. Meanwhile, the rear plate has a glass substrate, a data electrode formed one main surface of the glass substrate, an insulating layer to cover the data electrode, a barrier rib formed on the insulating layer, and phosphor layers formed between the barrier ribs and emitting red, green, blue light, respectively.

The protective layer has two main functions. One is to protect the dielectric layer against ion bombardment at the time of discharging. The other is to emit an initial electron to generate an address discharge. When the dielectric layer is protected against the ion bombardment, a discharge voltage is prevented from rising. When the number of initial electron emissions is increased, an address discharge error causing a flicker of an image can be prevented. In order to increase the number of initial electron emissions, there is known a technique to add an impurity in the MgO, or a technique to form MgO particles on a MgO film (e.g., refer to Patent Documents 1, 2, 3, 4, and 5).

PRIOR ART DOCUMENT

Patent Documents

[Patent Document 1] Unexamined Japanese Patent Publication No. 2002-260535

[Patent Document 2] Unexamined Japanese Patent Publication No. 11-339665

[Patent Document 3] Unexamined Japanese Patent Publication No. 2006-59779

[Patent Document 4] Unexamined Japanese Patent Publication No. 8-236028

[Patent Document 5] Unexamined Japanese Patent Publication No. 10-334809

SUMMARY OF THE INVENTION

A plasma display panel has a front plate, and a rear plate arranged so as to be opposed to the front plate. The front plate has a display electrode, a dielectric layer to cover the display electrode, and a protective layer to cover the dielectric layer. The protective layer has a luminescence peak in a wavelength ranging from not less than 350 nm to not more than 550 nm under irradiation of light having a wavelength of 146 nm. In addition, the protective layer has a luminescence peak in a wavelength ranging from not less than 350 nm to not more than 550 nm under irradiation of light having a wavelength of 173 nm. A ratio between a peak intensity of luminescence under the light having the wavelength of 146 nm and a peak intensity of luminescence under the light having the wavelength of 173 nm falls within a range from more than 3.0 to not more than 7.0.

DESCRIPTION OF EMBODIMENTS

1. Structure of PDP 1

Figure 1:
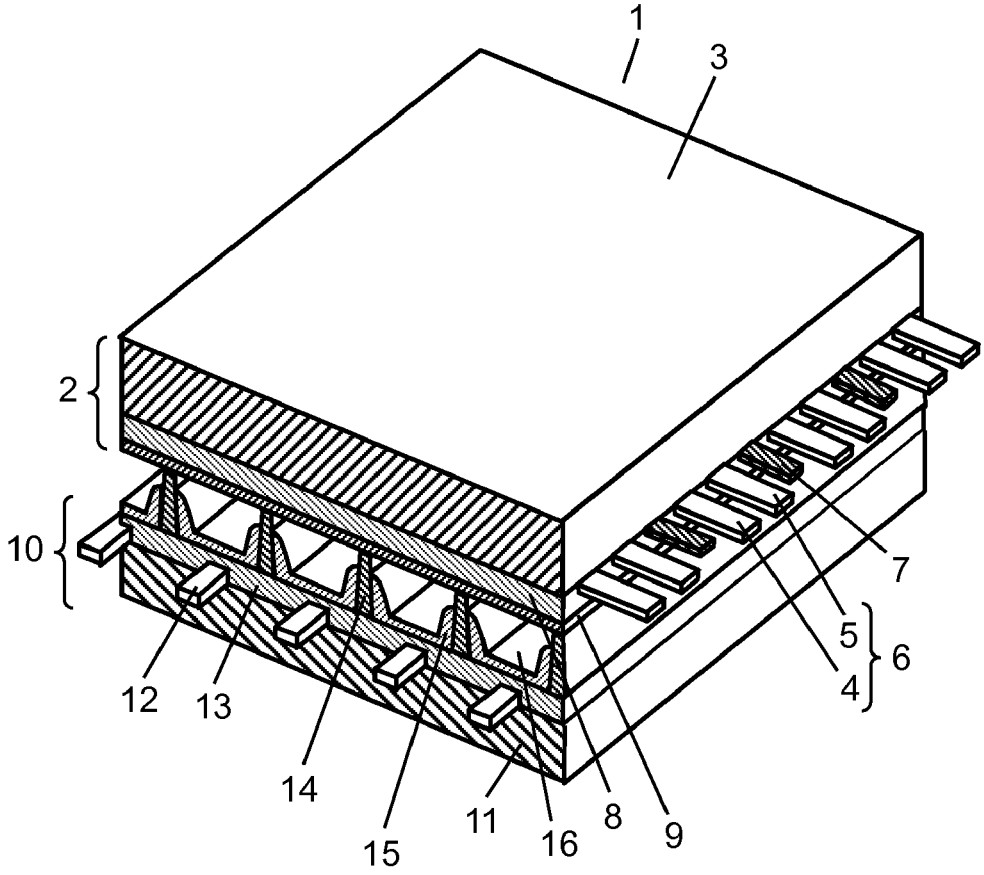
FIG. 1 is a perspective view showing a structure of a PDP according to an embodiment.

A basic structure of a PDP corresponds to that of a general alternating current (AC) surface discharge type PDP. As shown in FIG. 1, PDP 1 is provided in such a manner that front plate 2 including front glass substrate 3, and rear plate 10 including rear glass substrate 11 are arranged so as to be opposed to each other. Peripheral parts of front plate 2 and rear plate 10 are hermetically sealed by a sealing material such as a glass frit. A discharge gas such as neon (Ne) and xenon (Xe) is sealed at a pressure of 53 kPa (400 Torr) to 80 kPa (600 Torr) in discharge space 16 provided in sealed PDP 1.

Pairs of band-shaped display electrodes 6 each composed of scan electrode 4 and sustain electrode 5, and black stripes 7 are arranged on front glass substrate 3 so as to be parallel to each other. Dielectric layer 8 serving as a capacitor is formed on front glass substrate 3 so as to cover display electrodes 6 and black stripes 7. In addition, protective layer 9 composed of a magnesium oxide (MgO) is formed on a surface of dielectric layer 8. In addition, protective layer 9 will be described in detail below.

Each of scan electrode 4 and sustain electrode 5 is constituted in such a manner that a bus electrode composed of Ag is laminated on a transparent electrode composed of a conductive metal oxide such as an indium tin oxide (ITO), tin oxide ($SnO_2$), or zinc oxide (ZnO).

Data electrodes 12 each composed of a conductive material mainly containing silver (Ag) are arranged parallel to each other on rear glass substrate 11 in a direction perpendicular to display electrodes 6. Data electrode 12 is covered with insulating layer 13. Furthermore, barrier rib 14 having a predetermined height is formed on insulating layer 13 between data electrodes 12 to section discharge space 16. Phosphor layer 15 emitting red light, phosphor layer 15 emitting green light, and phosphor layer 15 emitting blue light under ultraviolet rays are sequentially applied and formed with respect to each data electrode 12, in a groove formed between barrier ribs 14. A discharge cell is formed at a position in which display electrode 6 and data electrode 12 intersect with each other. The discharge cell having red, green, and blue phosphor layers 15 arranged in a direction along display electrode 6 serves as a pixel for a color display.

In addition, according to this embodiment, the discharge gas sealed in discharge space 16 contains 10% by volume to 30% by volume of Xe.

Figure 2:
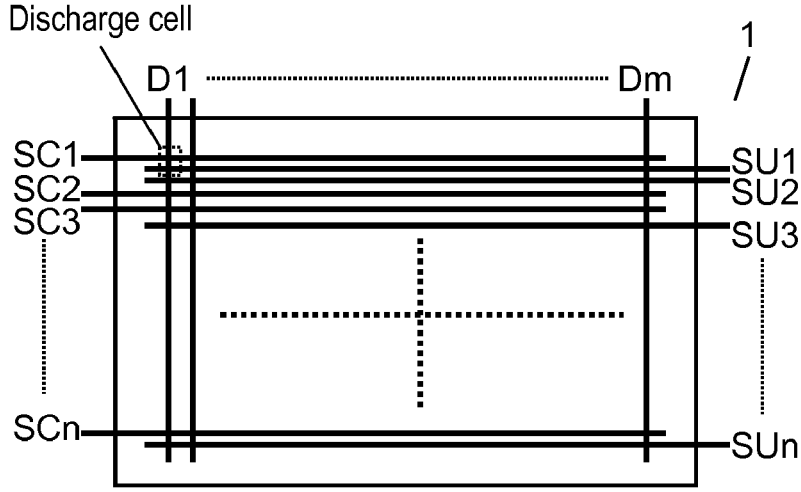
FIG. 2 is an electrode arrangement view of the PDP according to the embodiment.

As shown in FIG. 2, PDP 1 has n scan electrodes SC1, SC2, SC3, . . . SCn (shown by 4 in FIG. 1) arranged so as to extend in a row direction. PDP 1 has n sustain electrodes SU1, SU2, SU3, . . . SUn (shown by 5 in FIG. 1) arranged so as to extend in the row direction. PDP 1 has m data electrodes D1 . . . Dm (shown by 12 in FIG. 1) arranged so as to extend in a column direction. Thus, the discharge cell is formed at a part in which one pair of scan electrode SC1 and sustain electrode SU1 intersects with one data electrode D1. Thus, m×n discharge cells are formed in the discharge space. Each of the scan electrode and the sustain electrode is connected to a connection terminal provided in a peripheral end of the front plate outside an image display region. The data electrode is connected to a connection terminal provided in a peripheral end of the rear plate outside an image display region.

2. Structure of Plasma Display Device

Figure 3:
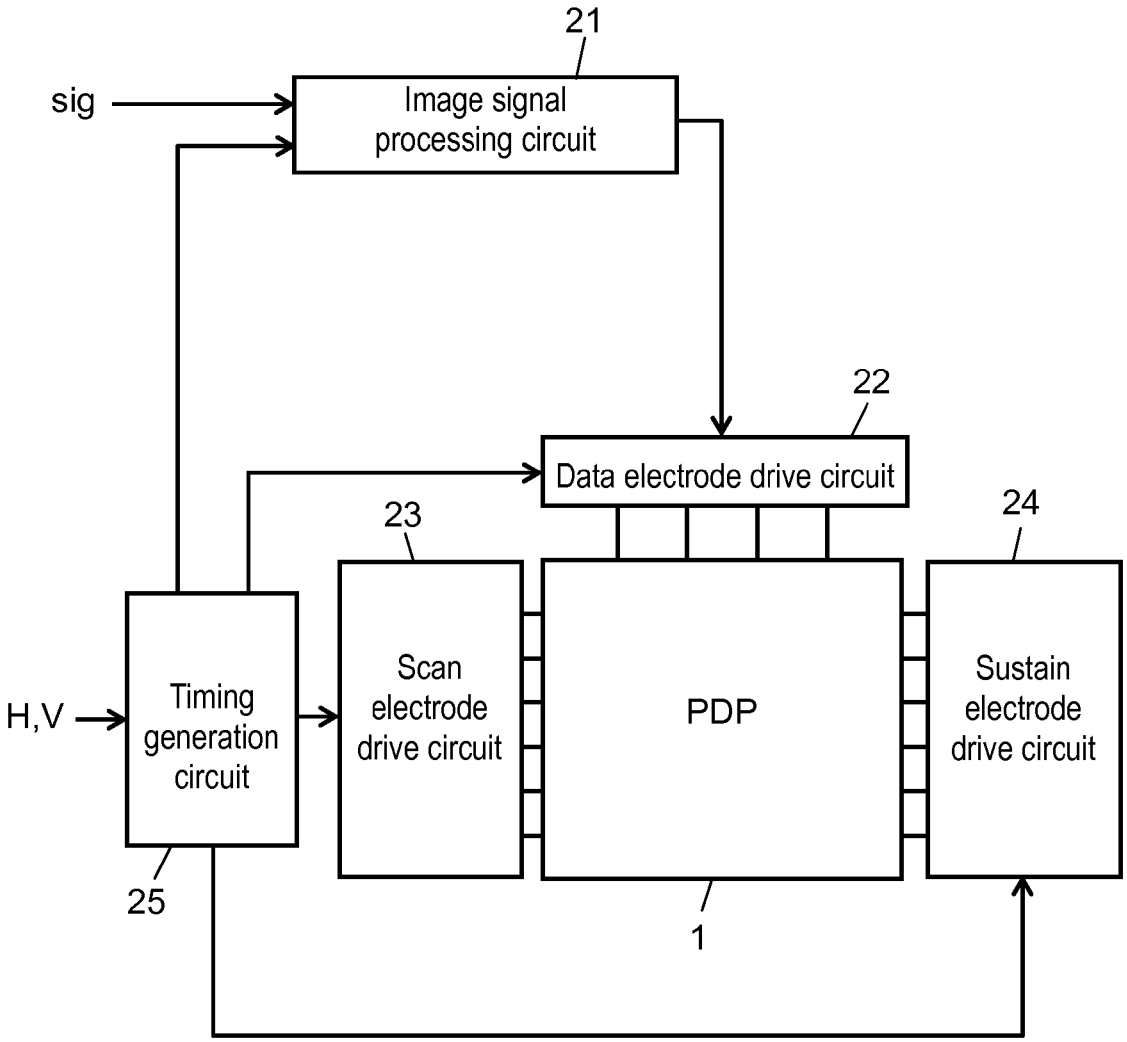
FIG. 3 is a block circuit diagram of a plasma display device according to the embodiment.

As shown in FIG. 3, a plasma display device includes PDP 1, image signal processing circuit 21, data electrode drive circuit 22, scan electrode drive circuit 23, sustain electrode drive circuit 24, timing generation circuit 25, and a power supply circuit (not shown).

Image signal processing circuit 21 converts image signal sig to image data with respect to each subfield. Data electrode drive circuit 22 converts the image data of respective subfields to signals corresponding to data electrodes D1 to Dm, respectively, and drives data electrodes D1 to Dm. Timing generation circuit 25 generates various kinds of timing signals based on a horizontal synchronous signal H and a vertical synchronous signal V and supplies them to each drive circuit block. Scan electrode drive circuit 23 supplies a drive voltage waveform to scan electrodes SC1 to SCn based on the timing signal. Sustain electrode drive circuit 24 supplies a drive voltage waveform to sustain electrodes SU1 to SUn based on the timing signal.

3. Drive of PDP 1

Figure 4:
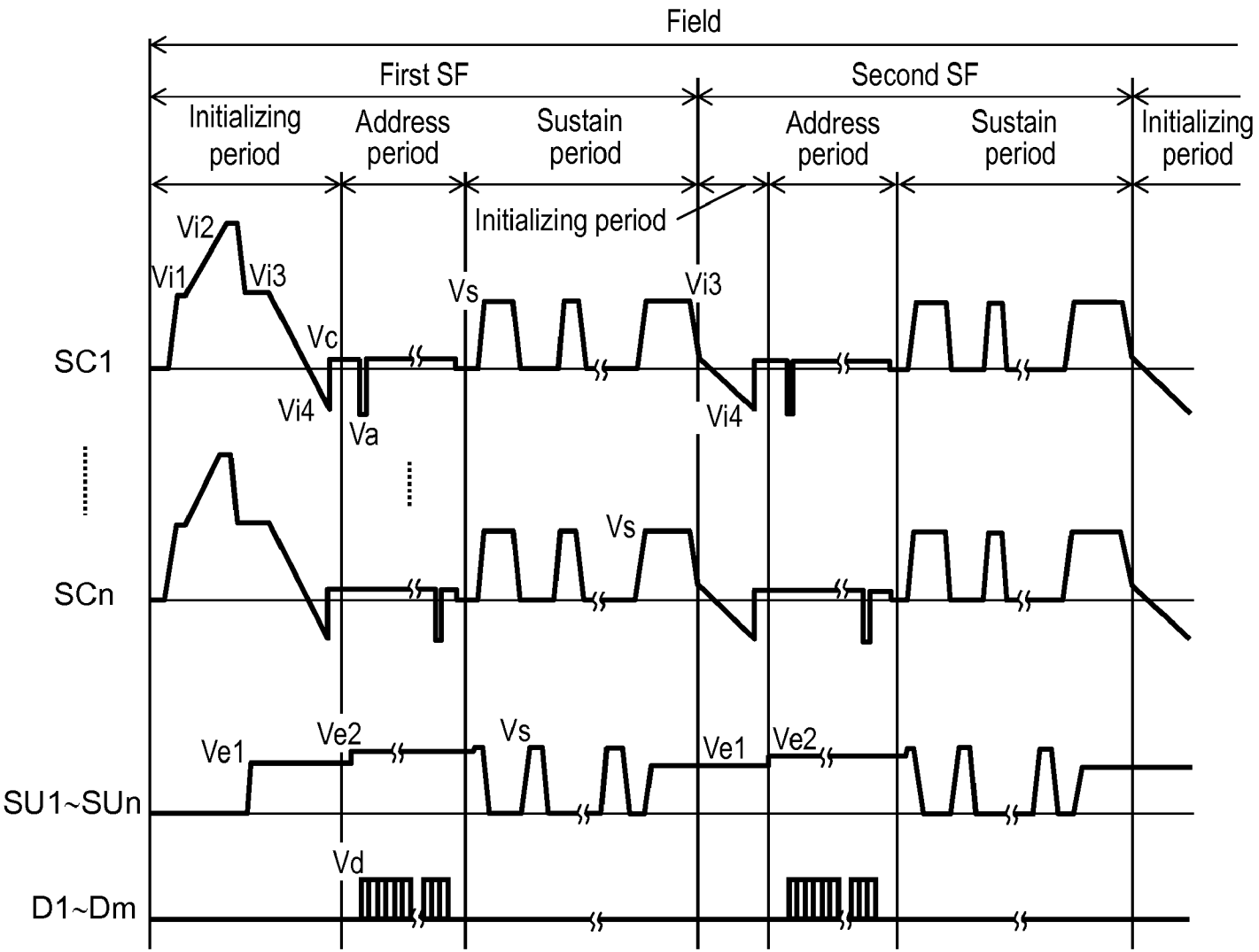
FIG. 4 is a drive voltage waveform chart of the plasma display device according to the embodiment.

As shown in FIG. 4, in the plasma display device, one field is composed of the plurality of subfields. The subfield has an initializing period, an address period, and a sustain period. During the initializing period, an initializing discharge is generated in the discharge cell. During the address period, an address discharge is generated to select the discharge cell which emits light, after the initializing period. During the sustain period, a sustain discharge is generated in the discharge cell selected in the address period.

3-1. Initializing Period

During the initializing period of a first subfield, data electrodes D1 to Dm and sustain electrodes SU1 to SUn are held at 0 (V). In addition, a ramp voltage gently rising from voltage Vi1 (V) which is a discharge start voltage or lower, to voltage Vi2 (V) which exceeds the discharge start voltage is applied to scan electrodes SC1 to SCn. Then, a first weak initializing discharge is generated in all of the discharge cells. A negative wall voltage is accumulated on scan electrodes SC1 to SCn by the initializing discharge. A positive wall voltage is accumulated on sustain electrodes SU1 to SUn and data electrodes D1 to Dm. The wall voltage is a voltage generated by wall electric charges accumulated on protective layer 9 and phosphor layer 15.

After that, sustain electrodes SU1 to SUn are held at positive voltage Ve1 (V), and a lamp voltage which gently drops from the voltage Vi3 (V) to voltage Vi4 (V) is applied to scan electrodes SC1 to SCn. Thus, a second weak initializing discharge is generated in all of the discharge cells. The wall voltage between scan electrodes SC1 to SCn and sustain electrodes SU1 to SUn is weakened. The wall voltage on the data electrodes D1 to Dm is adjusted to a value appropriate for an address operation.

3-2. Address Period

During the next address period, scan electrodes SC1 to SCn are held at Vc (V) once. Sustain electrodes SU1 to SUn are held at Ve2 (V). Then, negative scan pulse voltage Va (V) is applied to scan electrode SC1 in a first row, and positive address pulse voltage Vd (V) is applied to data electrode Dk (k=1 to m) of the discharge cell to be displayed in the first row among data electrodes D1 to Dm. At this time, a voltage at an intersection part of data electrode Dk and scan electrode SC1 is calculated by adding the wall voltage on data electrode Dk and the wall voltage on scan electrode SC1 to externally applied voltage (Vd−Va) (V), and exceeds the discharge start voltage. Thus, the address discharge is generated between data electrode Dk and scan electrode SC1 and between sustain electrode SU1 and scan electrode SC1. A positive wall voltage is accumulated on scan electrode SC1 of the discharge cell in which the address discharge has been generated. A negative wall voltage is accumulated on sustain electrode SU1 of the discharge cell in which the address discharge has been generated. A negative wall voltage is accumulated on data electrode Dk of the discharge cell in which the address discharge has been generated.

Meanwhile, a voltage at intersection parts of data electrodes D1 to Dm and scan electrode SC1 to which address pulse voltage Vd (V) has not been applied does not exceed the discharge start voltage. Consequently, the address discharge is not generated. The above address operations are sequentially performed until the discharge cell in an n-th row. The address period completes when the address operation in the discharge cell in the n-th row is completed.

3-3. Sustain Period

During the next sustain period, positive sustain pulse Vs (V) is applied to scan electrodes SC1 to SCn as a first voltage. A ground potential, that is, 0 (V) is applied to sustain electrodes SU1 to SUn as a second voltage. At this time, a voltage between scan electrode SCi and sustain electrode SUi in the discharge cell in which the address discharge has been generated is calculated by adding the wall voltage on scan electrode SCi and the wall voltage on sustain electrode SUi to sustain pulse voltage Vs (V), and exceeds the discharge start voltage. Thus, the sustain discharge is generated between scan electrode SCi and sustain electrode SUi. The phosphor layer is energized and emits light under ultraviolet rays generated due to the sustain discharge. Thus, a negative wall voltage is accumulated on scan electrode SCi. A positive wall voltage is accumulated on sustain electrode SUi. A positive wall voltage is accumulated on data electrode Dk.

In the discharge cell in which the address discharge has not been generated during the address period, the sustain discharge is not generated. Thus, the wall voltage at the time of the completion of the initializing period is held. Then, 0 (V) serving as the second voltage is applied to the scan electrodes SC1 to SCn. Sustain pulse voltage Vs (V) serving as the first voltage is applied to the sustain electrodes SU1 to SUn. Then, in the discharge cell in which the sustain discharge has been generated, the voltage between the sustain electrode SUi and the scan electrode SCi exceeds the discharge start voltage. Therefore, the sustain discharge is generated between the sustain electrode SUi and the scan electrode SCi again. That is, a negative wall voltage is accumulated on sustain electrode SUi. A positive wall voltage is accumulated on scan electrode SCi.

Similarly, the sustain pulse voltage Vs (V) whose number corresponds to a luminance weight is alternately applied to scan electrodes SC1 to SCn and sustain electrodes SU1 to SUn, whereby the sustain discharge is continuously generated in the discharge cell in which the address discharge has been generated during the address period. When the predetermined number of applications of sustain pulse voltage Vs (V) is completed, a sustain operation in the sustain period is completed.

3-4. In Second Subfield or Later

Next operations in the initializing period, the address period, and the sustain period in the second subfield or later are almost the same as the operations in the first subfield. Consequently, a detailed description for them is omitted. In addition, in the second subfield or later, sustain electrode SU1 to SUn are held at positive voltage Ve1 (V). A ramp voltage which gently drops from voltage Vi3 (V) to voltage Vi4 (V) is applied to scan electrodes SC1 to SCn. Thus, the weak initializing discharge is generated only in the discharge cell in which the sustain discharge is generated in the previous subfield. That is, in the first subfield, the initializing discharge is generated in all of the discharge cells, that is, an all-cell initializing operation is performed. In the second subfield or later, the initializing discharge is selectively generated only in the discharge cell in which the sustain discharge has been generated in the previous subfield, that is, a selective initializing operation is performed. In addition, the all-cell initializing operation and the selective initializing operation are performed in the first subfield and the subsequent subfields, respectively in this embodiment. However, the all-cell initializing operation may be performed in the initializing period in the subfield other than the first subfield. In addition, the all-cell initializing operation may be performed once in the several fields.

In addition, the operations in the address period and the sustain period are the same as those in the first subfield described above. However, the operation in the sustain period is not always the same as the operation in the first subfield described above. In order to generate the sustain discharge so that the luminance corresponding to image signal sig can be obtained, the number of sustain discharge pulse Vs (V) changes. That is, the sustain period is driven to control the luminance in each subfield.

4. Relationship Between Photoluminescence Spectrum and Secondary Electron Emission Coefficient Incidentally, the sustain discharge voltage can be lowered by enhancing a secondary electron emission ability of the protective layer. The inventors have repeated experiments and deliberations, assuming that when an oxygen defect is formed in the protective layer, the secondary electron emission ability can be enhanced in the protective layer. As a result, they have found the relationship between photoluminescence (PL) spectrum and the secondary electron emission ability in protective layer 9. In this embodiment, it is assumed that when protective layer 9 is irradiated with vacuum ultraviolet light having a wavelength of 146 nm, "A" represents luminescence peak intensity in a wavelength range of 350 nm to 550 nm. Furthermore, it is assumed that when protective layer 9 is irradiated with vacuum ultraviolet light having a wavelength of 172 nm, "B" represents luminescence peak intensity in a wavelength range of 350 nm to 550 nm. The inventors have confirmed that the sustain discharge voltage can be lowered when a ratio A/B between the peak intensity is 3.0 or more.

Figure 5:
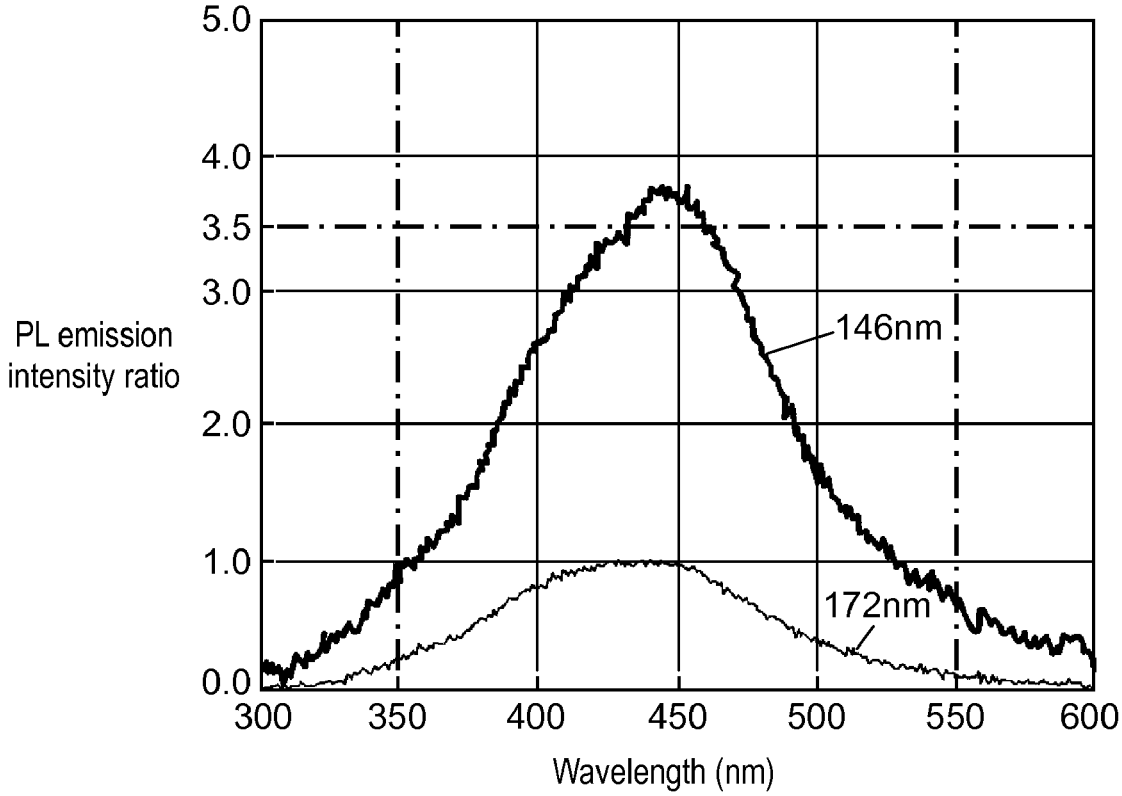
FIG. 5 is a diagram showing a photoluminescence spectrum of a protective layer according to the embodiment.

As shown in FIG. 5, protective layer 9 in this embodiment has a luminescence peak around a wavelength of 440 nm under the irradiation of light having the wavelength of 146 nm. In addition, protective layer 9 has a luminescence peak around a wavelength of 440 nm under the irradiation of light having the wavelength of 172 nm. A vertical axis in FIG. 5 shows a relative value when the luminescence peak intensity under the irradiation of the light having the wavelength of 172 nm is set to 1. As shown in FIG. 5, the ratio A/B of protective layer 9 is about 3.8 in this embodiment. The sustain discharge voltage of PDP 1 having protective layer 9 in this embodiment can be about 10 V lower than that of the conventional PDP having a protective layer whose ratio A/B is about 2 or less.

In addition, the inventors have produced the plurality of PDPs each having a protective layer in which the ratio A/B is different. More specifically, the ratios A/B are about 3, about 3.5, and 5 to 7. The sustain discharge voltage of the PDP having the protective layer in which the ratio A/B is about 3 is the same as that of the conventional PDP. The sustain discharge voltage of the PDP having the protective layer in which the ratio A/B is about 3.5 is about 10 V lower than that of the conventional PDP. The sustain discharge voltage of the PDP having the protective layer in which the ratio A/B is 5 to 7 is 15 V to 25 V lower than that of the conventional PDP. Therefore, the ratio A/B is preferably more than 3.0 and not more than 7.0.

5. Method for Measuring PL Spectrum

Figure 6:
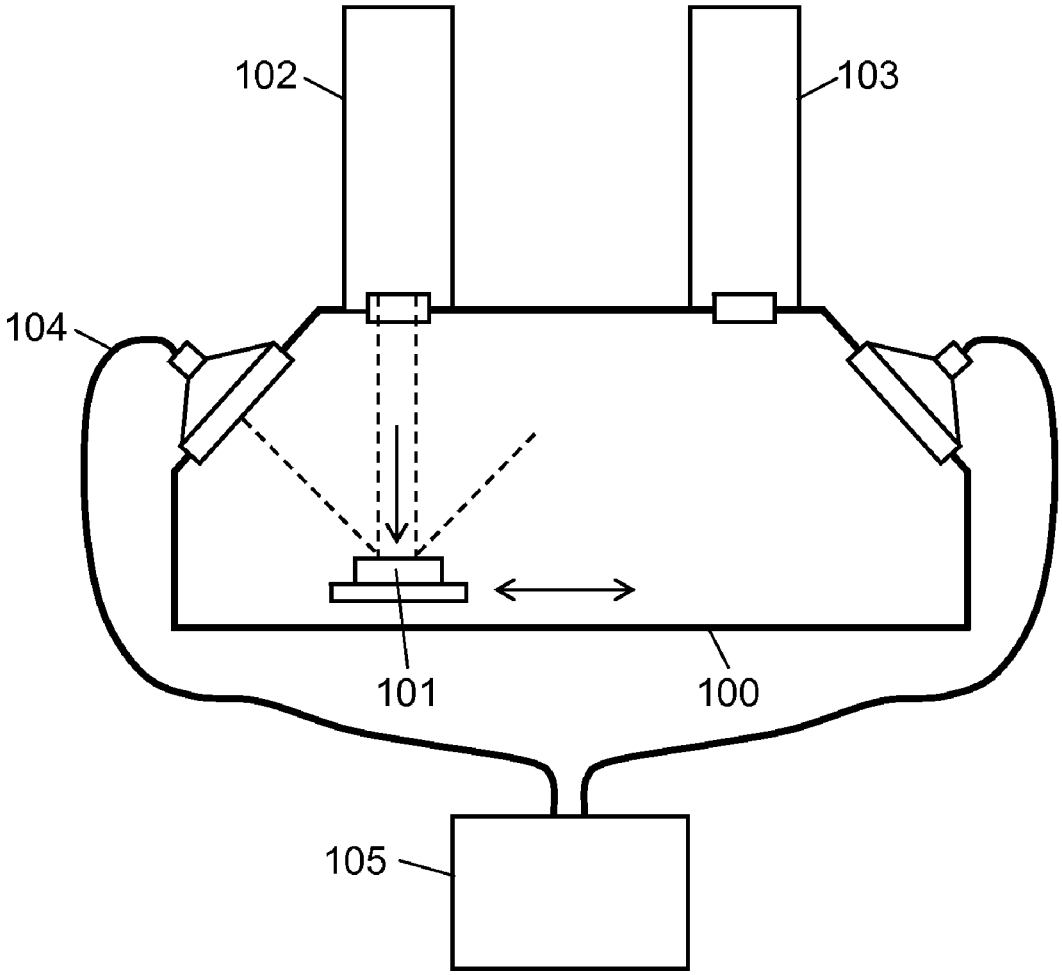
FIG. 6 is a schematic view showing a photoluminescence spectrum measurement device.

As shown in FIG. 6, sample 101 set in vacuum chamber 100 is vertically irradiated with vacuum ultraviolet light having the wavelength of 146 nm from lamp system 102 (SUS07 made by USHIO INC.). In addition, sample 101 is a substrate on which the protective layer is formed. In addition, luminescence from sample 101 falls on two-dimensional high-resolution type of CCD spectrometer 105 (Solid Lambda CCD UV-NIR made by Spectra Co-op Co., Ltd.) through optical system 104 including a lens and optical fiber. CCD spectrometer 105 generates wavelength dispersion (PL spectrum) of the incident luminescence. That is, it generates the PL spectrum of sample 101 irradiated with the vacuum ultraviolet light having the wavelength of 146 nm. In addition, lamp system 103 (SUS03 made by USHIO INC.) is also provided in vacuum chamber 100. That is, it generates PL spectrum of sample 101 irradiated with the vacuum ultraviolet light having the wavelength of 172 nm. According to this embodiment, the PL spectrum of the protective layer is measured by the measurement device shown in FIG. 6.

6. Method for Producing PDP 1

Figure 7:
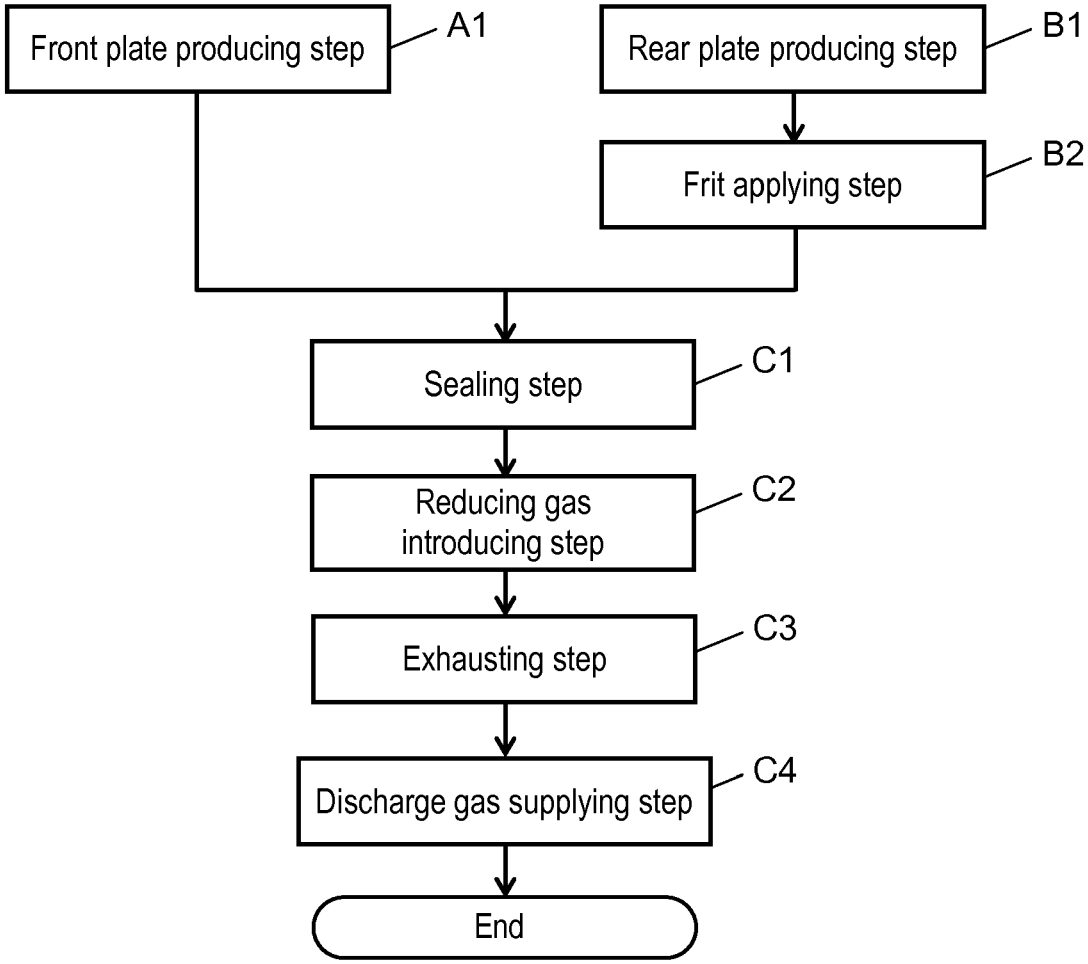
FIG. 7 is a flowchart showing one example of a method for producing the PDP according to the embodiment.

As shown in FIG. 7, a method for producing PDP 1 according to this embodiment includes front plate producing step A1, rear plate producing step B1, frit applying step B2, sealing step C1, reducing gas introducing step C2, exhausting step C3, and discharging gas supplying step C4.

6-1. Front Plate Producing Step A1

In front plate producing step A1, scan electrode 4, sustain electrode 5, and black stripe 7 are formed on front glass substrate 3 by photolithography. Scan electrode 4 and sustain electrode 5 have metal bus electrodes 4*b* and 5*b* containing silver (Ag), respectively to ensure conductivity. In addition, scan electrode 4 and sustain electrode 5 have transparent electrodes 4*a* and 5*a*, respectively. Metal bus electrode 4*b* is laminated on transparent electrode 4*a*. Metal bus electrode 5*b* is laminated on transparent electrode 5*a*.

Transparent electrodes 4*a* and 5*a* are each made of an indium tin oxide (ITO) to ensure transparency and electric conductivity. First, an ITO thin film is formed on front glass substrate 3 by sputtering. Then, transparent electrodes 4*a* and 5*a* are formed into predetermined patterns by lithography.

Metal bus electrodes 4*b* and 5*b* are made of an electrode paste containing silver (Ag), a glass frit to bind the silver, a photosensitive resin, and a solvent. First, the electrode paste is applied onto front glass substrate 3 by screen printing. Then, the solvent is removed from the electrode paste in a baking oven. Then, the electrode paste is exposed with a photomask having a predetermined pattern interposed therebetween.

Then, the electrode paste is developed and a metal bus electrode pattern is formed. Finally, the metal bus electrode pattern is fired at a predetermined temperature in a baking oven. That is, the photosensitive resin is removed from the metal bus electrode pattern. In addition, the glass frit melts in the metal bus electrode pattern. The molten glass frit becomes glass after the firing process. Through the above steps, metal bus electrodes 4*b* and 5*b* are formed.

Black stripe 7 is made of a material containing a black pigment. Then, dielectric layer 8 is formed. Dielectric layer 8 is made of a dielectric paste containing a dielectric glass frit, a resin, and a solvent. First, the dielectric paste is applied onto front glass substrate 3 by die coating so as to have a predetermined thickness to cover scan electrode 4, sustain electrode 5, and black stripe 7. Then, the solvent is removed from the dielectric paste in the draying furnace. Finally, the dielectric paste is fired at a predetermined temperature in the baking oven. That is, the resin is removed from the dielectric paste. In addition, the dielectric glass frit melts. The molten dielectric glass frit becomes glass after the firing process. Through the above steps, dielectric layer 8 is formed. Here, the dielectric paste may be applied by screen printing, or spin coating other than the die coating. In addition, a film used as dielectric layer 8 may be formed by CVD (Chemical Vapor Deposition) without using the dielectric paste.

A material of dielectric layer 8 contains at least one kind selected from a bismuth oxide ($Bi_2O_3$), calcium oxide (CaO), strontium oxide (SrO), and barium oxide (BaO), and at least one kind selected from a molybdenum oxide ($MoO_3$), tungsten oxide (WO3), cerium oxide ($CeO_2$), and manganese dioxide ($MnO_2$). A binder component is ethyl cellulose, terpineol containing 1% by weight to 20% by weight of acrylic resin, or butyl carbitol acetate. In addition, in the paste, if needed, dioctyl phthalate, dibutyl phthalate, triphenyl phosphate, or tributyl phosphate is added in the paste as a plasticizer, and glycerol monooleate, sorbitan sesquioleate, homogenol (made by Kao Corporation), or alkyl aryl group ester phosphate is added as a dispersant to improve printing characteristics of the paste.

Next, protective layer 9 is formed on dielectric layer 8. Protective layer 9 will be described in detail below.

Through the above steps, scan electrode 4, sustain electrode 5, black stripe 7, dielectric layer 8, and protective layer 9 are formed on front glass substrate 3, whereby front plate 2 is completed.

6-2. Rear Panel Producing Step B1

First, data electrode 12 is formed on rear glass substrate 11 by photolithography. Data electrode 12 is made of a data electrode paste containing silver (Ag) to ensure conductivity, a glass frit to bind the silver, a photosensitive resin, and a solvent. First, the data electrode paste is applied onto rear glass substrate 11 by screen printing so as to have a predetermined thickness. Then, the solvent is removed from the data electrode paste in the baking oven. Then, the data electrode paste is exposed with a photomask having a predetermined pattern interposed therebetween. Then, the data electrode paste is developed, whereby a data electrode pattern is formed. Finally, the data electrode pattern is fired at a predetermined temperature in the baking oven. That is, the photosensitive resin is removed from the data electrode pattern. In addition, the glass frit melts in the data electrode pattern. The molten glass frit becomes a glass after the firing process. Through the above steps, data electrode 12 is formed. Here, the data electrode paste may be applied by sputtering or evaporation other than the screen printing.

Then, insulating layer 13 is formed. Insulating layer 13 is made of an insulating paste containing a dielectric glass frit, a resin, and a solvent. First, the insulating paste is applied onto rear glass substrate 11 having data electrode 12 by screen printing so as to have a predetermined thickness and to cover data electrode 12. Then, the solvent is removed from the insulating paste in the baking oven. Finally, the insulating paste is fired at a predetermined temperature in the baking oven. That is, the resin is removed from the insulating paste. In addition, the dielectric glass frits melts. The molten insulating glass frit becomes glass after the firing process. Through the above steps, insulating layer 13 is formed. Here, the insulating paste may be applied by die coating or spin coating other than the screen printing. In addition, a film used as insulating layer 13 may be formed by CVD (Chemical Vapor Deposition) without using the insulating paste.

Then, barrier rib 14 is formed by photolithography. Barrier rib 14 is made of a barrier rib paste containing a filler, a glass frit to bind the filler, a photosensitive resin, and a solvent. First, the barrier rib paste is applied onto insulating layer 13 by die coating so as to have a predetermined thickness. Then, the solvent is removed from the barrier rib paste in the baking oven. Next, the barrier rib paste is exposed with a photomask having a predetermined pattern interposed therebetween. Then, the barrier rib paste is developed and a barrier rib pattern is formed. Finally, the barrier rib pattern is fired at a predetermined temperature in the baking oven. That is, the photosensitive resin is removed from the barrier rib pattern. In addition, the glass frit melts in the barrier rib pattern. The molten glass frit becomes glass after the firing process. Through the above steps, barrier rib 14 is formed. Here, sandblasting may be used instead of the photolithography.

Then, phosphor layer 15 is formed. Phosphor layer 15 is made of a phosphor paste containing phosphor particles, a binder, and a solvent. First, the phosphor paste is applied onto insulating layer 13 provided between adjacent barrier ribs 14 and a side face of barrier rib 14 by dispensing so as to have a predetermined thickness. Then, the solvent is removed from the phosphor paste in the baking oven. Finally, the phosphor paste is fired at a predetermined temperature in the baking oven. That is, the resin is removed from the phosphor paste. Through the above steps, phosphor layer 15 is formed. Here, screen printing may be used instead of the dispensing.

Through the above steps, rear plate 10 having the predetermined components on rear glass substrate 11 is completed.

6-3. Frit Applying Step B2

Next, the glass frit serving as the sealing material is applied to rear plate 10 produced in rear plate producing step B1 outside the image display region. Then, frit applying step B2 is performed such that the glass frit is tentatively fired at a temperature of about 350° C. to remove a resin component in the glass frit.

Here, the sealing material preferably a frit which is mainly composed of a bismuth oxide, or vanadium oxide. The frit mainly composed of the bismuth oxide is provided by adding a filler composed of an oxide such as $Al_2O_3$, $SiO_2$, or cordierite, to a glass material of $Bi_2O_3$—$B_2O_3$—RO-MO group (here, R is Ba, Sr, Ca or Mg, and M is Cu, Sb, or Fe). In addition, the frit mainly composed of the vanadium oxide is provided by adding a filler composed of an oxide such as $Al_2O_3$, $SiO_2$, or cordierite, to a glass material of $V_2O_5$—BaO—TeO—WO group.

6-4. Sealing Step C1 to Discharge Gas Supplying Step C4

Then, front plate 2, and rear plate 10 which has been subjected to frit applying step B1 are arranged so as to be opposed, and their peripheral parts are sealed by the sealing material. Then, the discharge gas is sealed in the discharge space. Sealing step C1, reducing gas introducing step C2, exhausting step C3, and discharge gas supplying step C4 according to this embodiment are performed according to a temperature profile shown in FIG. 8 in the same device.

Figure 8:
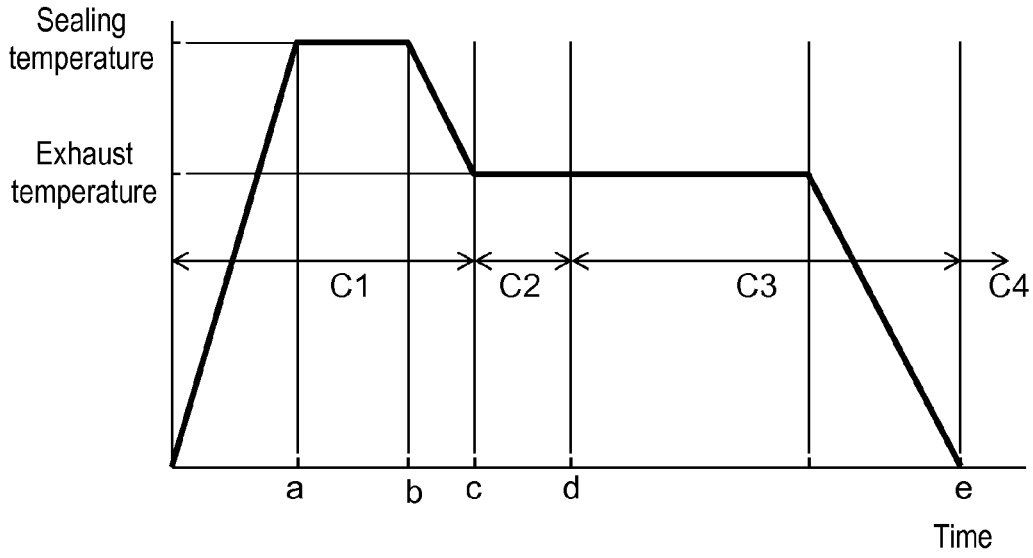
FIG. 8 is a diagram showing one example of a temperature profile used in producing the PDP according to the embodiment.

At a sealing temperature in FIG. 8, front plate 2 and rear plate 10 are sealed by the frit serving as the sealing material in sealing step C1. The sealing temperature in this embodiment is about 490° C. In addition, at an exhaust temperature in FIG. 8, exhausting step C3 is performed. The exhaust temperature in this embodiment is about 400° C.

First, in sealing step C1, a temperature rises from the room temperature to the sealing temperate. Then, the temperature is kept at the sealing temperature for a period of a-b. Then, the temperature drops from the sealing temperature to the exhaust temperature for a period of b-c. The discharge space is exhausted for the period of b-c. That is, a pressure is reduced in the discharge space.

Next, the temperature is kept at the exhaust temperature for a period of c-d in reducing gas introducing step C2. A gas containing a reducing organic gas is introduced into the discharge space for the period of c-d. Protective layer 9 is exposed to the gas containing the reducing organic gas for the period of c-d.

Then, the temperature is kept at the exhaust temperature for a predetermined period, in exhausting step C3. Then, the temperature drops to the room temperature. The discharge space is exhausted for a period of d-e, so that the gas containing the reducing organic gas is removed.

Then, the discharge gas is introduced into the discharge space in discharge gas supplying step C4. That is, the discharge gas is introduced for a period after a time e in which the temperature drops to the room temperature.

The reducing organic gas is preferably a CH group organic gas having a molecular weight of 58 or less and a high reducing power. The gas containing the reducing organic gas is produced by mixing at least one gas selected from the various kinds of reducing organic gasses, with a rare gas or a nitrogen gas.

Furthermore, there is a possibility that the gas containing the reducing organic gas partially remains in the discharge space after exhausting step C3. Therefore, the reducing organic gas preferably has characteristics of being easily decomposed. The reducing organic gas is preferably a hydrocarbon group gas which is selected from acetylene, ethylene, methyl acetylene, propadiene, propylene, and cyclopropane and does not contain oxygen because it is easily handled during the production process, and it is easily decomposed. At least one kind selected from the above reducing organic gases may be used after mixed with the rare gas or the nitrogen gas.

In addition, a lower limit of a mixture ratio between the rare gas or the nitrogen gas and the reducing organic gas is determined based on a burn rate of the reducing organic gas to be used. An upper limit thereof is about several percent by volume. When the mixture ratio of the reducing organic gas is too high, organic component is polymerized and becomes a high polymer. In this case, the high polymer remains in the discharge space and affects the PDP characteristics. Thus, it is preferable that the mixture ratio is appropriately adjusted, based on the component of the reducing organic gas to be used.

7. Detail of Protective Layer 9

Figure 9:
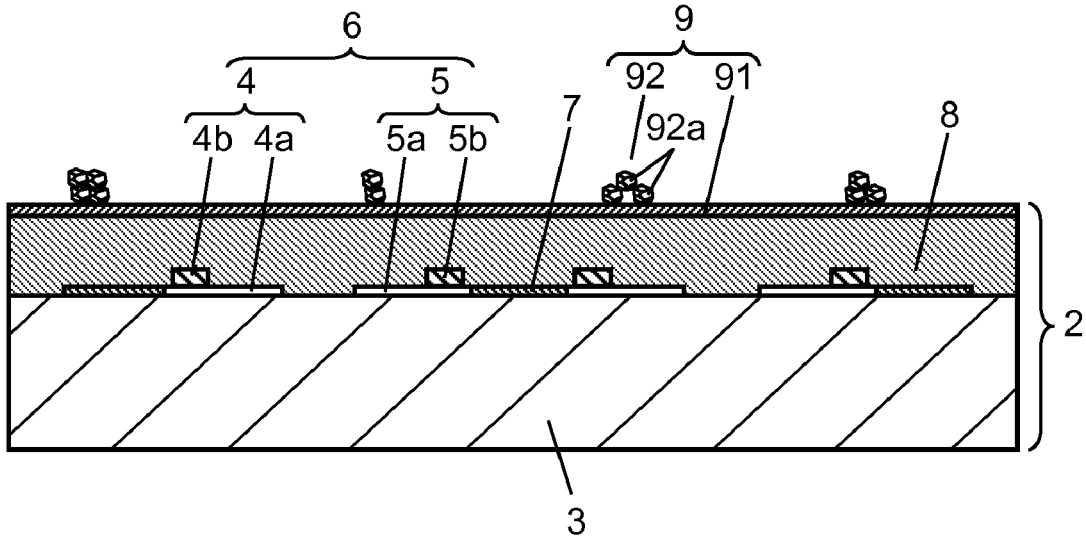
FIG. 9 is a schematic view showing a cross-section of the PDP according to the embodiment.

As shown in FIG. 9, protective layer 9 includes base film 91 serving as the base layer and aggregated particles 92. Base film 91 may be formed of a metal oxide composed of at least two oxides selected from a MgO, calcium oxide (CaO), strontium oxide (SrO), and barium oxide (BaO). The above metal oxide has a peak between a minimum diffraction angle and a maximum diffraction angle generated from a simple substance of an oxide which constitutes the metal oxide on a specific azimuth surface when a surface of base film 91 is analyzed by X-ray diffraction.

Aggregated particle 92 is composed of a plurality of crystal particles 92*a* of a MgO as the metal oxide. It is preferable that aggregated particles 92 are uniformly dispersed all over the surface of base film 91. This is because a variation in discharge voltage can be reduced in PDP 1.

In addition, crystal particle 92*a* of the MgO can be produced by vapor phase synthesis or precursor firing. According to the vapor phase synthesis, a metal magnesium material having purity of 99.9% or more is heated in an atmosphere filled with an inert gas. Then, a little amount of oxygen is introduced in the atmosphere, so that the metal magnesium is directly oxidized. Thus, crystal particle 92*a* of the MgO is produced.

According to the precursor firing, a precursor of the MgO is uniformly fired at a high temperature of 700° C. or more. Then, it is gradually cooled down, whereby crystal particle 92*a* of the MgO is produced. The precursor may be at least one kind of compound among magnesium alkoxide ($Mg(OR)_2$), magnesium acetylacetone ($Mg(acac)_2$), magnesium hydroxide ($Mg(OH)_2$), magnesium carbonate ($MgCo_2$), magnesium chloride ($MgCl_2$), magnesium sulfate ($MgSO_4$), magnesium nitrate ($Mg(NO_3)_2$), and magnesium oxalate ($MgC_2O_4$). In addition, the compound may be typically a hydrate. The precursor may be a hydrate. The compound serving as the precursor is adjusted such that purity of the magnesium oxide (MgO) obtained after the firing is to be 99.95% or more, or preferably 99.98% or more. When a certain amount or more of an impurity element of alkali metal such as B, Si, Fe, or Al is mixed in the compound serving as the precursor, unnecessary particles are adhered to each other or fired during the heat treatment. As a result, the crystal particle of the MgO having high crystallinity is hardly obtained. Thus, it is preferable that the precursor is previously adjusted such that the impurity element is removed from the compound.

A dispersion liquid is produced by dispersing crystal particles 92*a* of the MgO obtained by the above method, in a solvent. Then, the dispersion liquid is applied to the surface of base film 91 by spraying, screen printing, or electrostatic spraying. Then, the solvent is removed through drying and firing steps. Through the above steps, crystal particles 92*a* of the MgO are fixed onto the surface of base film 91.

8. Detail of Aggregated Particle 92

Aggregated particle 92 is formed such that crystal particles 92*a* each having a predetermined primary particle diameter are bonded by aggregation or necking. That is, they are not bonded with strong bonding force as a solid, but a plurality of primary particles are bonded as an aggregate by static electricity or van der Waals' force, so that they partially or wholly become a primary particle state by external stimulus such as an ultrasonic wave. A particle diameter of aggregated particle 92 is about 1 μm, and crystal particle 92*a* preferably has a form of a polyhedron having seven or more flat faces such as a cuboctahedron or dodecahedron.

In addition, a particle diameter of the primary particle of crystal particle 92*a* can be controlled by a condition for forming crystal particle 92*a*. For example, in a case where it is formed by firing the precursor of the magnesium carbonate or magnesium hydroxide, its particle diameter can be controlled by controlling a firing temperature or a firing atmosphere. In general, the firing temperature can be selected from a range of 700° C. to 1500° C. When the firing temperature is set to a relatively high temperature of 1000° C. or higher, the particle diameter can be 0.3 to 2 μm. In addition, when the precursor is heated, aggregated particle 92 having the primary particles bonded by aggregation or necking can be obtained in its production process.

It is confirmed by experiments by the inventors that aggregated particle 92 composed of the aggregated crystal particles of the MgO has an effect to prevent "discharge delay" mainly in the address discharge, and an effect to improve temperature dependency of the "discharge delay". Aggregated particle 92 is superior in initial electron emission characteristics compared with base film 91. Thus, according to this embodiment, aggregated particle 92 is provided as a part to supply an initial electron required when a discharge pulse rises.

The "discharge delay" is supposed to be mainly caused by a deficiency of an amount of initial electrons serving as the trigger and emitted from the surface of base film 91 to discharge space 16 to start the discharge. Therefore, aggregated particles 92 are dispersed on the surface of base film 91 in order to stably supply the initial electrons to discharge space 16. As a result, there are sufficient electrons in discharge space 16 when the discharge pulse rises, so that the discharge delay can be prevented. Thus, due to such initial electron emission characteristics, high-speed driving superior in discharge responsiveness can be realized even when PDP 1 is a high-definition PDP. In addition, according to the configuration in which aggregated particles 92 of the metal oxide are arranged on the surface of base film 91, in addition to the main effect to prevent the "discharge delay" in the address discharge, the effect to improve the temperature dependency of the "discharge delay" can be obtained.

9. Experiment Result

Next, a description will be made of an experiment result performed to confirm the characteristics of protective layer 9 according to this embodiment. Sample 1 is a PDP having a protective layer only made of a MgO. Sample 2 is a PDP having a MgO protective layer doped with an impurity such as Al or Si. Sample 3 is a PDP provided such that primary particles of MgO crystal particles are dispersed on a MgO base film. Sample 4 is a PDP provided such that aggregated particles 92 composed of MgO crystal particles 92*a* are uniformly dispersed all over a MgO base film. In addition, PDPs of samples 1 to 4 are produced by the above-described producing method. Samples 1 to 4 are only different in the structure of protective layer 9. Furthermore, a ratio A/B of peak intensity of protective layer 9 in each of samples 1 to 4 is more than 3.0 and not more than 7.0. A sustain voltage of each of samples 1 to 4 is 10 V to 20 V lower than the sustain voltage of the conventional PDP.

Figure 10:
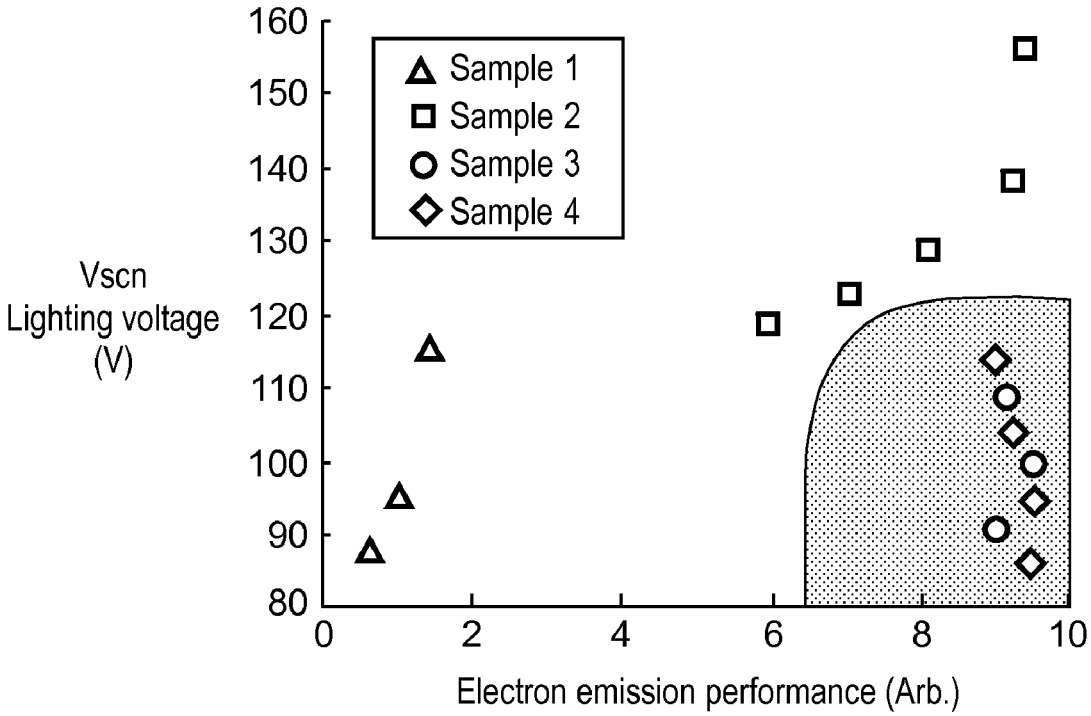
FIG. 10 is a diagram showing electron emission performance and a Vscn lighting voltage.

FIG. 10 shows electron emission performance and charge retention performance of the protective layer. As for the electron emission performance, as its value increases, an electron emission amount becomes large. The electron emission performance is expressed as an initial electron emission amount determined by a surface state of the discharge, a gas kind, and its state. The initial electron emission amount can be measured by measuring an electronic current amount emitted from the surface when the surface is irradiated with an ion or electron beam. However, it is difficult to measure by a non-destructive way. Thus, a method disclosed in a Unexamined Japanese Patent Publication No. 2007-48733 is used. That is, the method measures a value which provides an indication of ease of discharge generation, called a statistical delay time of delay times of the discharge. When an inverse number of the statistical delay is integrated, the value linearly corresponds to the emission amount of the initial electrons. The delay time of the discharge corresponds to a time from rising of the address discharge pulse until the address discharge is generated later. The discharge delay is supposed to be mainly caused because the initial electron serving as the trigger to generate the address discharge is not easily emitted from the protective layer surface to the discharge space.

The charge retention performance is expressed by a voltage (hereinafter, referred to as the Vscn lighting voltage) applied to the scan electrode to prevent an electric charge from being emitted from the protective layer in the PDP. The lower the Vscn lighting voltage is, the higher the charge retention ability is. When the Vscn lighting voltage is low, the PDP can be driven at a low voltage. Thus, a component which is low in withstand voltage and low in capacity can be used as a power supply or an electric component. As for a current product, an element having a withstand voltage as low as 150 V is used as a semiconductor switching element such as a MOSFET provided to sequentially apply the scan voltage to the panel. The Vscn lighting voltage is preferably 120 V or lower in view of a variation due to temperature.

In general, the electron emission ability of the protective layer contradicts with the charge retention ability thereof. The electron emission performance can be improved by changing a condition for forming the protective layer, or doping an impurity such as Al, Si, or Ba in the protective layer in a film formation process. However, the Vscn lighting voltage also rises as an adverse effect.

As can be seen from FIG. 10, the electron emission ability of the protective layer of each of sample 3 and sample 4 is more than eight times as high as that of sample 1. As for the charge retention ability of the protective layer of each of sample 3 and sample 4, the Vscn lighting voltage is 120 V or lower. Therefore, the PDPs of sample 3 and sample 4 are more useful in realizing a high-definition PDP having many scan lines and small in cell size. That is, the PDPs of sample 3 and sample 4 satisfy both of the electron emission ability and the charge retention ability, and realize a preferable image display at a lower voltage.

10. Summary

PDP 1 disclosed in this embodiment has front plate 2, and rear plate 10 arranged so as to be opposed to front plate 2. Front plate 2 has display electrode 6, dielectric layer 8 to cover display electrode 6, and protective layer 9 to cover dielectric layer 8. Protective layer 9 has the luminescence peak in the wavelength ranging from not less than 350 nm to not more than 550 nm under the irradiation of the light having the wavelength of 146 nm. In addition, protective layer 9 has the luminescence peak in the wavelength ranging from not less than 350 nm to not more than 550 nm under the irradiation of the light having the wavelength of 173 nm. The ratio A/B between a peak intensity of luminescence under the light having the wavelength of 146 nm and a peak intensity of luminescence under the light having the wavelength of 173 nm falls within a range from more than 3.0 to not more than 7.0.

PDP 1 having protective layer 9 according to this embodiment can lower the sustain voltage.

Furthermore, protective layer 9 may have base film 91 serving as the base layer formed on dielectric layer 8, and crystal particles 92*a* of the metal oxide dispersed on base film 91.

Still furthermore, protective layer 9 may have base film 91 serving as the base layer formed on dielectric layer 8, and crystal particles dispersed on base film 91, and the particle may be aggregated particle 92 of crystal particles 92*a* of the metal oxide.

When protective layer 9 has crystal particles 92*a* of the metal oxide or aggregated particle 92 of crystal particles 92*a* of the metal oxide, over the surface of base film 91, it has the high charge retention ability and the high electron emission ability. Therefore, PDP 1 can realize high-speed drive at a low voltage in the high-definition PDP as a whole. In addition, it can realize a high-quality image display performance in which a lighting defect is prevented.

In addition, the MgO film is illustrated as the base layer in the above description. However, the performance required for the base layer is to have higher sputter-resistant performance to protect the dielectric body against ion bombardment. That is, the charge retention ability and the electron emission performance are not necessarily high. According to the conventional PDP, the protective layer is made mainly of a MgO in many cases in order to achieve the certain level of the electron emission performance and the sputter-resistant performance. However, as for a case of the configuration in which the electron emission performance is dominantly controlled by the crystal particles of the metal oxide, there is no need for the base film to be made of the MgO. The base film may be made of another material having excellent impact resistance such as $Al_2O_3$.

In addition, according to this embodiment, the MgO is illustrated as the crystal particles of the metal oxide. However, the same effect can be realized by crystal particles of another metal oxide such as Sr, Ca, Ba, or Al having high electron emission performance like the MgO. Thus, the crystal particle of the metal oxide is not limited to the MgO.

Industrial Applicability

As described above, the technique disclosed in this embodiment is useful in realizing the PDP having high-resolution display performance, keeping power consumption low.

REFERENCE MARKS IN THE DRAWING

1 PDP
2 front plate
3 front glass substrate
4 scan electrode
4*a*, 5*a* transparent electrode
4*b*, 5*b* metal bus electrode
5 sustain electrode
6 display electrode
7 black stripe
8 dielectric layer
9 protective layer
10 rear plate
11 rear glass substrate
12 data electrode
13 insulating layer
14 barrier rib
15 phosphor layer
16 discharge space
21 image signal processing circuit
22 data electrode drive circuit
23 scan electrode drive circuit
24 sustain electrode drive circuit
25 timing generation circuit
91 base film
92 aggregated particle
92*a* crystal particle
100 vacuum chamber
101 sample
102, 103 lamp system
104 optical system
105 CCD spectrometer

The invention claimed is:

1. A plasma display panel comprising:

a front plate; and a rear plate arranged so as to be opposed to the front plate, wherein the front plate has a display electrode, a dielectric layer to cover the display electrode, and a protective layer to cover the dielectric layer, the protective layer has a luminescence peak in a wavelength ranging from not less than 350 nm to not more than 550 nm under irradiation of light having a wavelength of 146 nm, the protective layer further has a luminescence peak in a wavelength ranging from not less than 350 nm to not more than 550 nm under irradiation of light having a wavelength of 173 nm, and a ratio between a peak intensity of luminescence under the light having the wavelength of 146 nm and a peak intensity of luminescence under the light having the wavelength of 173 nm falls within a range from more than 3.0 to not more than 7.0.

2. The plasma display panel according to claim 1, wherein the protective layer includes a base layer formed on the dielectric layer, and a plurality of particles dispersed on the base layer, and each of the particles is a crystal particle of metal oxide.

3. The plasma display panel according to claim 1, wherein the protective layer includes a base layer formed on the dielectric layer, and a plurality of particles dispersed on the base layer, and each of the particle is an aggregated particle of a plurality of crystal particles of metal oxide.

* * * * *